US005410851A

United States Patent [19]

Restrepo

[11] Patent Number: 5,410,851

[45] Date of Patent: May 2, 1995

[54] SLOTTED FLOOR SLAB FOR THE TWO-STAGE CONSTRUCTION OF LEVEL CONCRETE PLATES

[76] Inventor: Jose M. Restrepo, Fibrit Ltda., A.A. 88745, Santafe de Bogota, D.C., Colombia

[21] Appl. No.: 181,441

[22] Filed: Jan. 14, 1994

Related U.S. Application Data

[63] Continuation of Ser. No. 888,070, May 26, 1992, abandoned.

[30] Foreign Application Priority Data

May 28, 1991 [AR] Argentina ..... 319790

[51] Int. Cl.[6] ..... E04B 1/16

[52] U.S. Cl. ..... 52/381; 52/258; 52/425; 52/437; 52/600; 52/605; 404/34

[58] Field of Search ..... 52/309.13, 309.14, 309.15, 52/309.16, 258, 259, 335, 338, 600, 602, 605, 606, 607, 381, 612, 249, 425, 437, 439, 921; 404/34, 42, 45, 41

[56] References Cited

U.S. PATENT DOCUMENTS

| | | | |
|---|---|---|---|
| 1,412,504 | 4/1922 | Byrne | 404/42 |
| 1,521,922 | 1/1925 | Wilson et al. | 52/607 |
| 1,907,170 | 5/1933 | A'Hearn | 52/606 X |
| 3,352,079 | 11/1967 | Strong | 52/581 X |
| 4,056,910 | 11/1977 | Hiatt et al. | 52/309.1 |
| 4,285,179 | 8/1981 | Goidinger | 52/309.12 |
| 4,306,395 | 12/1981 | Carpenter | 52/309.12 |

FOREIGN PATENT DOCUMENTS

| | | | |
|---|---|---|---|
| 144378 | 6/1920 | United Kingdom | 52/607 |

*Primary Examiner*—Carl D. Friedman
*Assistant Examiner*—Kien Nguyen
*Attorney, Agent, or Firm*—Browdy and Neimark

[57] ABSTRACT

Shuttering floor slab for the two-phase construction of level concrete plates, which is thin and rectangular or polygonal in shape and contains the bending reinforcement of the final slab, used to form a level monolithic structure by assembly and embedded bonding of an upper layer to conform the final slab, characterized in that its body contains multiple parallel longitudinal passages connected to its upper surface by symetrically located slots placed on the longitudinal parallel axes of the passages, and having interrupted continuity, thus creating an intimate connection between the poured upper layer and the shuttering floor slab, through the material of the upper layer itself when this material enters into the longitudinal passages of the slotted floor slab through the slots in the upper face of said slab.

12 Claims, 2 Drawing Sheets

SLOTTED FLOOR SLAB FOR THE TWO-STAGE CONSTRUCTION OF LEVEL CONCRETE PLATES

This application is a continuation of application Ser. No. 07/888,070, filed May 26, 1992, now abandoned.

BACKGROUND OF THE INVENTION

This invention pertains to a rectangular or polygonal lab having slots in one of its faces communicating with a plurality of longitudinal passages in the body of the slab. The slab is designed for use as a module in the two-stage construction of a poured concrete deck or plate. The rectangular or polygonal slab module is in the form of a slotted floor slab which serves as the lower form for the complete concrete deck or plate, and at the same time contains the bending reinforcement for the whole plate. The slab constitutes the first stage in the construction of the deck or plate. In constructing the concrete deck a plurality of slotted floor slab modules is engaged to the concrete deck or plate, when the concrete slurry to create the deck enters the longitudinal passages in the slotted floor slab through the slots in the face of the slab. The intimate connection between the slotted floor slab and the concrete deck created by the adherence of the concrete in the longitudinal walls of the passages in the upper face thereof allows both layers, that of the slotted floor slab, and that of the poured deck, to behave in an integral manner, constituting a completed full level deck or plate.

The fundamental characteristic which distinguishes the slotted floor slab from conventional two-stage floor plates lies in the process through which shearing or shearing stress is transmitted between the slotted floor slab and the upper deck of poured concrete, poured over such slotted slab, to conform the final floor plate. The slots in the upper face of the slotted floor slab allow the concrete of the upper deck to enter the longitudinal passages in the body of the slab and to become embedded inside the slotted floor slab, forming an intimate contact between the two elements, joined precisely to the cores and the lower reinforcement of the slotted floor slab, which in turn provides the main reinforcement of the deck or plate, thus achieving an excellent transmission of the diagonal shearing stress between the lower traction reinforcing and the compression zone in the upper deck.

Another very important distinguishing characteristic is the mechanism through which the slotted floor slab accommodates loads generated by construction and by the poured upper deck itself, because its elements for receiving compression stress, upper reinforcement and the upper surface of the element, are placed inside the rectangular parallelopiped of the part, rather than having protruding trusses on the upper face of the element, outside of its regular prismatic shape, as is true for the existing shuttering floor slabs. This is possible because the floor slab is considerably thick, while at the same time it is light in weight owing to the weight-reducing effect of the hollow parallel passages provided along the longitudinal axis of the element. The thickness is sufficiently significant so that a sheet of the slotted floor slabs offers a resisting moment which is capable of withstanding loads generated by handling and construction, aided only by a temporary form in the center of the span, if the span which is covered exceeds 25 times the thickness of the slotted floor slab.

Another considerable difference .in the slotted floor slab is that it requires less concrete in the poured upper layer. This results in savings in terms of the weight of the full deck, and savings in terms of materials in the poured upper layer. This is achieved by the thickness of the slotted floor slab, by virtue of which the concrete in the upper deck is generally totally within the compression zone of the full deck, because the required thickness of the poured upper deck is smaller than that of the slotted floor slab. While in conventional two-stage construction of floor slabs, the concrete in the upper layer remains well on both sides of the neutral axis of the final slab and thus the structural contribution of the mass under the plane of the neutral axis is nil, only serving negatively to increase the dead or static load of the full plate.

SUMMARY OF THE INVENTION

In general terms, the invention is a rectangular or polygonal slab having cylindrical hollow passages or openings distributed uniformly over the width of the slab. The axes of the passages are in the plane of the neutral axis of the transverse section of the slab and oriented parallel to the longitudinal axis of the slab. The lower face of the slab is reinforced with reinforcement rods parallel to the longitudinal axis thereof and pass through the separation cores placed between one passage and the other. The upper face contains compression reinforcement parallel to the longitudinal axis of the element and located near the edges and said upper surface, to absorb handling compression or bending stresses.

The upper face of either of the two longitudinal passages adjacent to a separation core having a reinforcing rod in its lower part is connected discontinuosly to the upper surface of the element through a variety of rectangular perforations or slots located over said opening, although separated from each other by continuity bridges in the upper surface of the element.

The element formed in this manner functions as a slotted floor slab wherein the components designed to absorb the traction stress when simple bending is applied are the reinforcing rods at the lower face. The components designed to absorb compression stress during simply-applied bending are at the upper face which include the lateral reinforcing rods therein. A rectangular parallelopiped slab which meets the following objectives is thus provided: the element is securely stable or sturdy, it is easy to handle, transport, and store, and the slotted floor slab and poured upper deck are connected by the interlocking of the poured upper deck into the slotted floor slab, to obtain the horizontal shearing strength between both decks, rather than obtaining such shearing strength from the transverse reinforcement rods of the truss which exists between the shuttering floor slab or lower deck, and the poured in-site upper deck of a conventional two-deck concrete slab.

BRIEF DESCRIPTION OF THE DRAWINGS

In order to provide more complete information on the constructive aspect of this invention, the accompanying drawings illustrate the following.

DETAILED DESCRIPTION OF THE PREFERRED EMBODIMENT OF THE INVENTION

In order to associate these drawings with the description which follows, the same reference number has been used to distinguish the same parts in the different figures.

Figure 1:
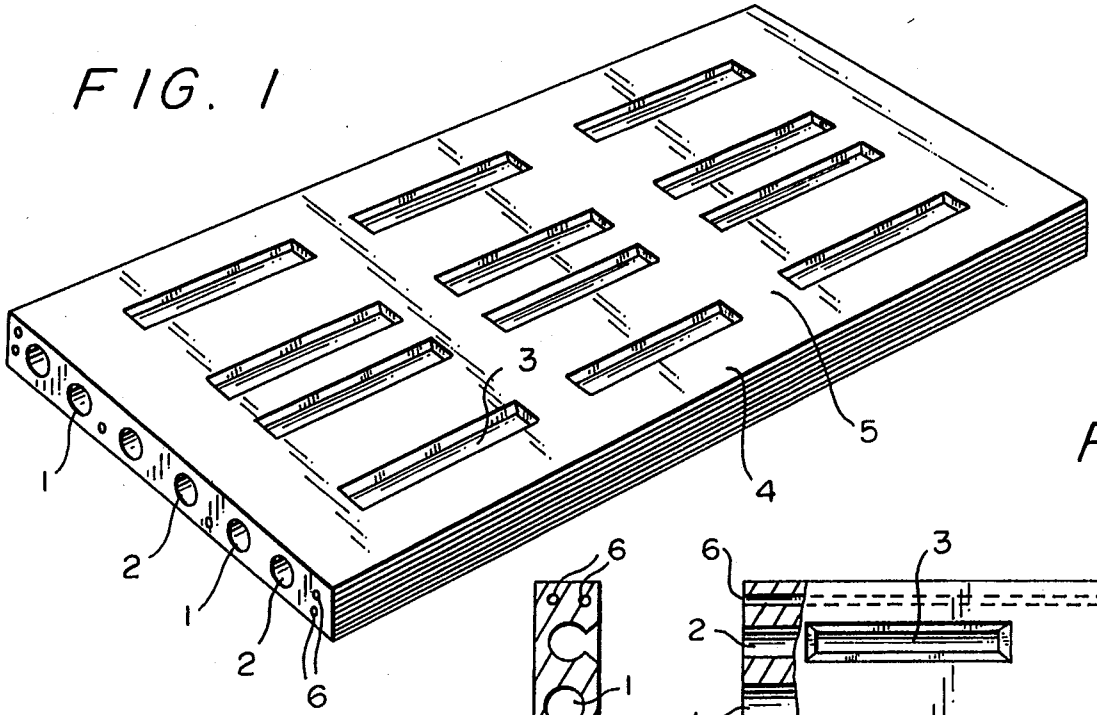
FIG. 1 is a perspective view.
Figure 2:
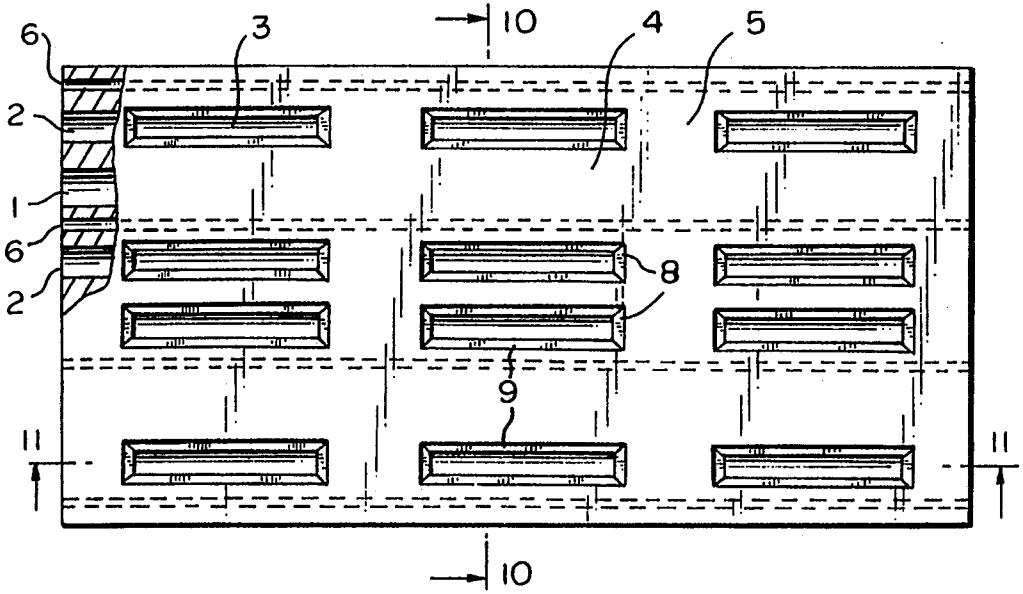
FIG. 2 is a plan view.
Figure 3:
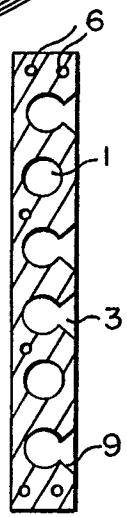
FIG. 3 is a view along cut line 10—10 of the above figure.
Figure 4:
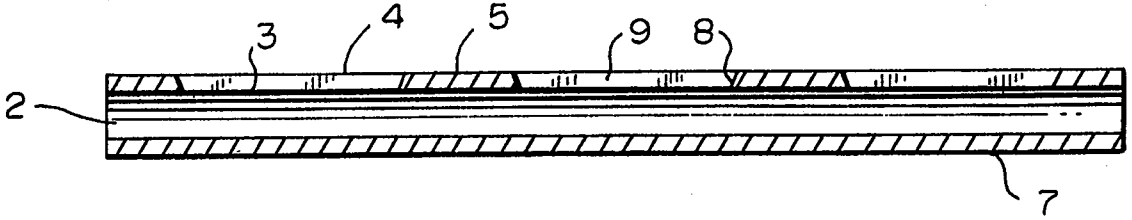
FIG. 4 is a view along cut line 11—11 of the same figure.
Figure 5:
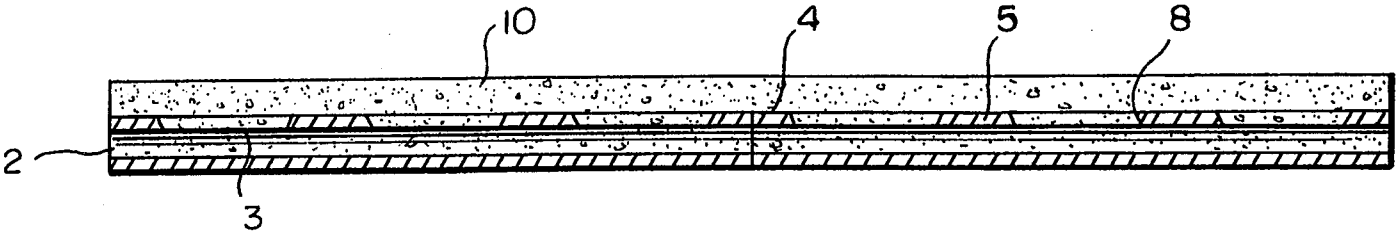
FIG. 5 is an elevation view through a plurality of the slotted slab according to the invention with a poured concrete deck thereon.

As anticipated, we see that the slotted floor slab in question is in the shape of an enlarged, thin rectangle. Multiple hollow passages or openings have been made in the body in parallel correspondence with its longitudinal axis, passing through its entire length, distributed symmetrically from its said axis. Passage openings 1 having circular sections are continuously closed throughout their length, while the openings of passages 2 are connected to the upper surface 4, by grooves 3, which have tampered downward edges 8, 9 into passages 2 from the upper face 4 of the slab to facilitate passage of poured concrete for concrete deck 10 into passages 2 as shown in FIG. 5. Bridges 5 on face 4 between grooves 3 maintain the cylindrical continuity of openings 2. Reinforcement rods 6 are inserted into the body of the slab. Rods 6 are shown at intermediate, central, and near sides in pairs. Four of rods 6 are shown proximate to the underside 7 of the slotted floor slab. These four rods 6 serve to reinforce the lower side of the slab when in tension due to the load of the poured deck or a load on the deck. The underside 7 of the slab has a totally smooth lower surface.

The above specification has established the process according to the invention which makes it possible to implement the above-mentioned objectives. However, it must be understood that the invention is not limited to the details described herein. Equivalent processes obvious to experts skilled in the technology pertinent to the invention are included in the scope thereof as defined according to the accompanying claims.

What is claimed is:

1. A monolithic floor structure having a plurality of floor slabs and a poured concrete deck over said floor slabs, each of said floor slabs comprising:

a thin rectangular concrete body, said rectangular body having an upper face, a lower face, and side walls, end walls engaged between said upper face and said lower face, a plurality of more than two parallel longitudinal tubular passages passing through a full length of said body and opening on said end walls, a periphery of each of said plurality of more than two parallel longitudinal tubular passages spaced internally from said upper face, said lower face said side walls over said full length of said body, said passages located below said upper face of said body, each of at least two passages of said plurality of longitudinal tubular passages having a plurality of slots communicating with said upper face of said body, and each of said plurality of slots being spaced apart from said end walls and each other over a length of said body, the remainder of said plurality of parallel longitudinal tubular passages extending said full length of said body without communicating with said upper face of said body, wherein said poured concrete deck of said monolithic structure is bonded to said plurality of said slabs when a selected amount of concrete is poured on said plurality of said slabs through said plurality of slots into an entire length of each of said at least two of said plurality of more than two parallel longitudinal tubular passages and over said upper face of each of said plurality of said slabs.

2. The monolithic floor structure according to claim 1, comprising:

a plurality of reinforcing rods spaced proximate to said lower face of said body.

3. The monolithic floor structure according to claim 2, comprising:

a plurality of reinforcing rods located proximate to said upper face of said body and parallel to said passages.

4. The monolithic floor structure according to claim 3, wherein, said slots have downwardly sloping edges.

5. The monolithic floor structure according to claim 3, wherein said body has six said parallel longitudinal tubular passages, four of the said six parallel longitudinal tubular passages having slots communicating with said upper face, and the remainder of said six parallel longitudinal tubular passages extending the full length of said body without communicating with said upper face of said body.

6. The monolithic floor structure according to claim 5, wherein two of said four parallel longitudinal tubular passages having slots communicating with said upper face are adjacent to the longitudinal axis of said body and the remaining two of said four parallel longitudinal tubular passages are each adjacent to one of the two longitudinal sides of said body.

7. A monolithic floor structure having a plurality of floor slabs and a poured concrete deck over said floor slabs, each of said floor slabs comprising a thin rectangular concrete body, said rectangular body having an upper face, a lower face, and side walls, end walls engaged between said upper face and said lower face, a plurality of more than two parallel longitudinal tubular passages passing through a full length of said body and opening on said end walls, an entire periphery of each of said longitudinal tubular passages spaced internally from said upper face, said lower face and said side walls over said full length of said body, each of at least two passages of said plurality of longitudinal tubular passages having a plurality of slots communicating with said upper face of said body, each of said plurality of slots being spaced apart from said end walls and each other over said full length of said body, a remainder of said tubular passages extending said full length of said body without communicating with said upper face of said body, wherein said poured concrete deck of said monolithic structure is bonded to said plurality of said slabs when a selected amount of concrete is poured on said plurality of said slabs through said plurality of slots into an entire length of each of said at least two of said longitudinal tubular passages and over said upper face of each of said plurality of said slabs.

8. The monolithic floor structure according to claim 7, comprising:

a plurality of reinforcing rods spaced proximate to said lower face of said body.

9. The monolithic floor structure according to claim 8, comprising:

a plurality of reinforcing rods spaced proximate to said upper face of said body and parallel to said passages.

10. The monolithic floor structure according to claim 9, wherein, said slots have downwardly sloping edges.

11. The monolithic floor structure according to claim 10, wherein said body has six said tubular passages, four of said six tubular passages having slots communicating with said upper face, and a remainder of said six tubular passages extending the full length of said body without communicating with said upper face of said body.

12. The monolithic floor structure according to claim 11, wherein two of said four tubular passages having slots communicating with said upper face are adjacent to the longitudinal axis of said body and the remaining two of said four tubular passages are each adjacent to one of two said longitudinal sides of said body.

* * * * *